US012022935B2

(12) United States Patent
Esnard

(10) Patent No.: US 12,022,935 B2
(45) Date of Patent: Jul. 2, 2024

(54) SYSTEM AND METHOD FOR AN EXFOLIATING DISPENSING APPARATUS

(71) Applicant: The Cut Buddy LLC, Pittsboro, NC (US)

(72) Inventor: Joshua Nickev Esnard, Pittsboro, NC (US)

(73) Assignee: The Cut Buddy, Inc., Pittsboro, NC (US)

( * ) Notice: Subject to any disclaimer, the term of this patent is extended or adjusted under 35 U.S.C. 154(b) by 3 days.

(21) Appl. No.: 17/960,011

(22) Filed: Oct. 4, 2022

(65) Prior Publication Data

US 2023/0189976 A1 Jun. 22, 2023

Related U.S. Application Data

(60) Provisional application No. 63/291,925, filed on Dec. 20, 2021.

(51) Int. Cl.
*B43M 11/06* (2006.01)
*A46B 9/00* (2006.01)
*A46B 11/00* (2006.01)

(52) U.S. Cl.
CPC ..... *A46B 11/0041* (2013.01); *A46B 9/005* (2013.01); *A46B 2200/1006* (2013.01); *A46B 2200/102* (2013.01); *A46B 2200/1033* (2013.01)

(58) Field of Classification Search
CPC ..... A46B 11/0041; A46B 9/005; A46B 2200/1006; A46B 2200/1033; A46B 2200/102
USPC ..... 401/183
See application file for complete search history.

(56) References Cited

U.S. PATENT DOCUMENTS

| | | | | |
|---|---|---|---|---|
| 4,974,984 | A * | 12/1990 | Kafkis | A45D 34/042 401/268 |
| 6,332,726 | B2 * | 12/2001 | Yamamoto | B65D 35/16 401/187 |
| 7,878,727 | B2 * | 2/2011 | Koptis | A46B 17/04 401/290 |
| 7,963,713 | B2 * | 6/2011 | Wang | A46B 11/0041 401/281 |
| 8,240,938 | B2 * | 8/2012 | Maxwell | A46B 11/0041 401/268 |
| 8,336,558 | B2 * | 12/2012 | Hurwitz | A46B 5/021 132/114 |
| 8,418,654 | B2 * | 4/2013 | Hurwitz | A01K 13/002 119/664 |
| 9,364,068 | B2 * | 6/2016 | Kodama | A45D 19/012 |
| 9,706,832 | B2 * | 7/2017 | Price | A46B 5/0075 |
| 11,019,908 | B1 * | 6/2021 | Schmidt | A45D 27/10 |

* cited by examiner

*Primary Examiner* — Jennifer C Chiang
(74) *Attorney, Agent, or Firm* — Bold IP PLLC; Christopher Mayle

(57) ABSTRACT

A system and method for a vessel or container with an exfoliating applicator attached to the vessel that provides a durable, practical, and customizable experience by including an exfoliating brush that screws or attaches to the vessel whereby liquid is squeezed or pushed through the main body of the exfoliating brush. During operation, the user holds the exfoliating brush while it is attached to the vessel and then the user rubs the produced shaving cream or liquid on their face or head thus spreading shaving cream or liquid while the bristles/spikes of the exfoliating brush exfoliate skin.

12 Claims, 4 Drawing Sheets

SYSTEM AND METHOD FOR AN EXFOLIATING DISPENSING APPARATUS

CROSS REFERENCE TO RELATED APPLICATIONS

This application claims priority to U.S. Provisional Patent No. 63/291,925 on Dec. 20, 2021 which is incorporated in its entirety.

FIELD OF DISCLOSURE

The overall field of this invention is a system and method for an applicator for a shaving cream or liquid and, more particularly, the invention is directed to an exfoliation brush connected to a vessel for applying the shaving cream or liquid on the skin.

BACKGROUND

Razor bumps—also known as ingrown hairs, or, if referring to them by their technical medical title, pseudofolliculitis barbae—occur following a shave once the individual hairs begin growing back. Thus, for men, these bumps typically appear on the face and neck. Symptoms include "small red or dark bumps around hair follicles, in addition to red and inflamed skin in the surrounding area." While men of all races and ethnicities can suffer from razor bumps, a majority of those afflicted with this unsightly skin condition happen to be black men. In fact, previous reports have claimed that black men actually make up an estimated 80% of the male population grappling with this issue. The best way to prevent this is to exfoliate skin before applying shaving cream or a cleanser. When exfoliating dead skin, it cleans and removes any dead skin that may irritate pores during shaving. However, no product offers a single all in one shaving and exfoliating dispensary system.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
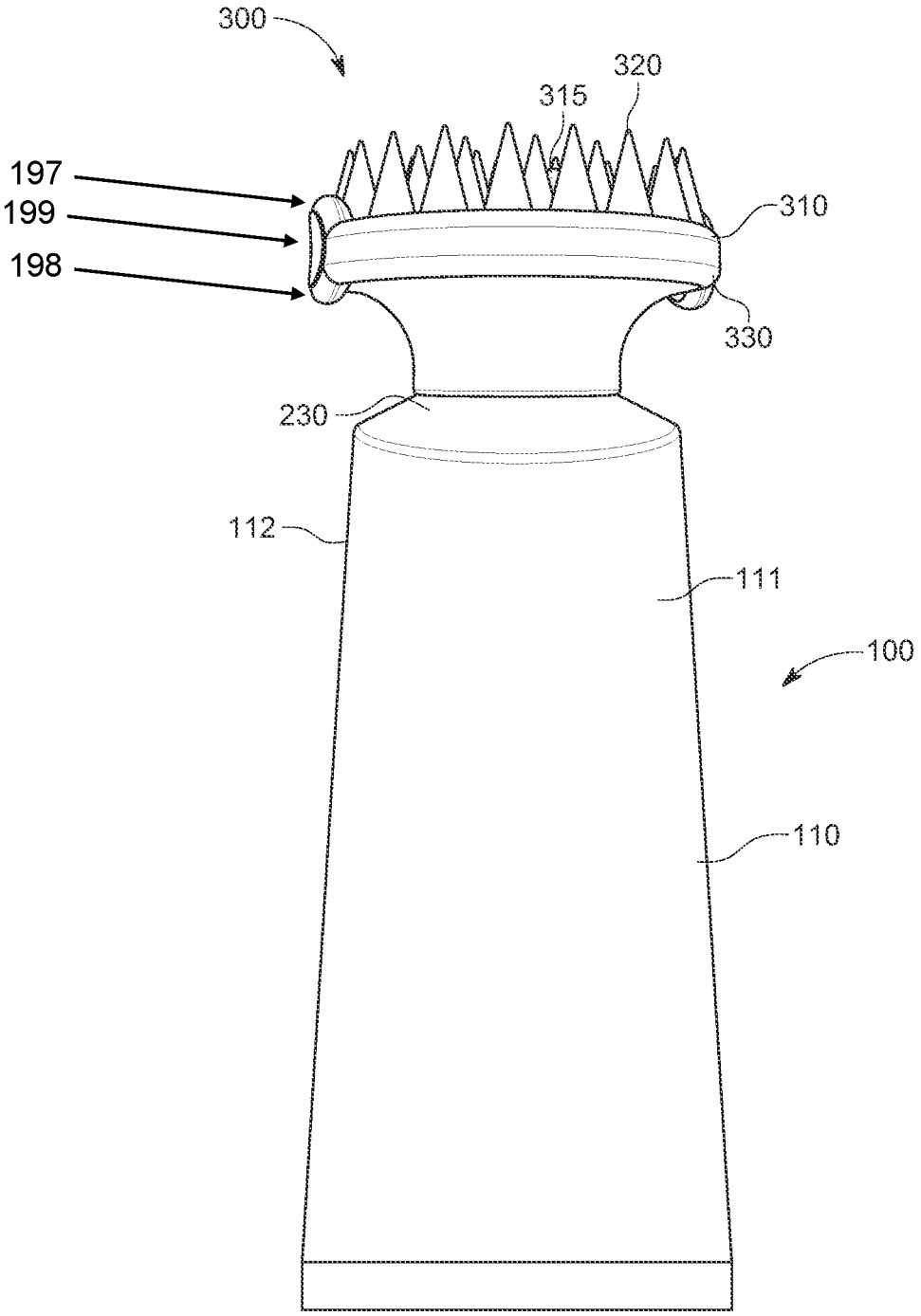
FIG. 1 depicts an illustration showing a perspective view of the exfoliating dispensing system.
Figure 2:
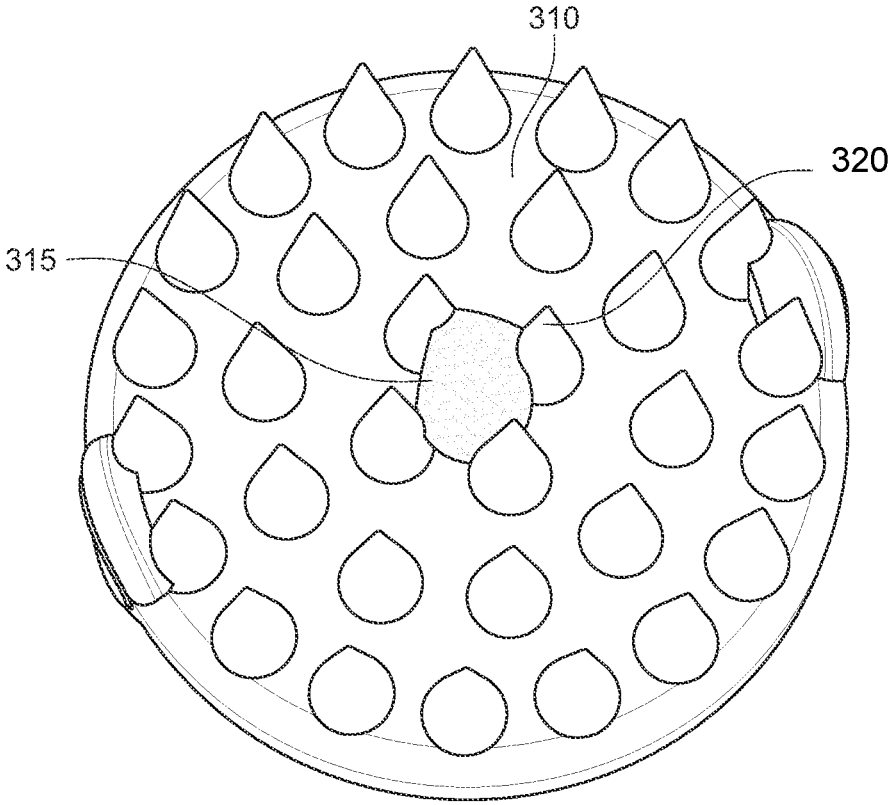
FIG. 2 depicts an illustration showing a top view of the exfoliating brush
Figure 3:
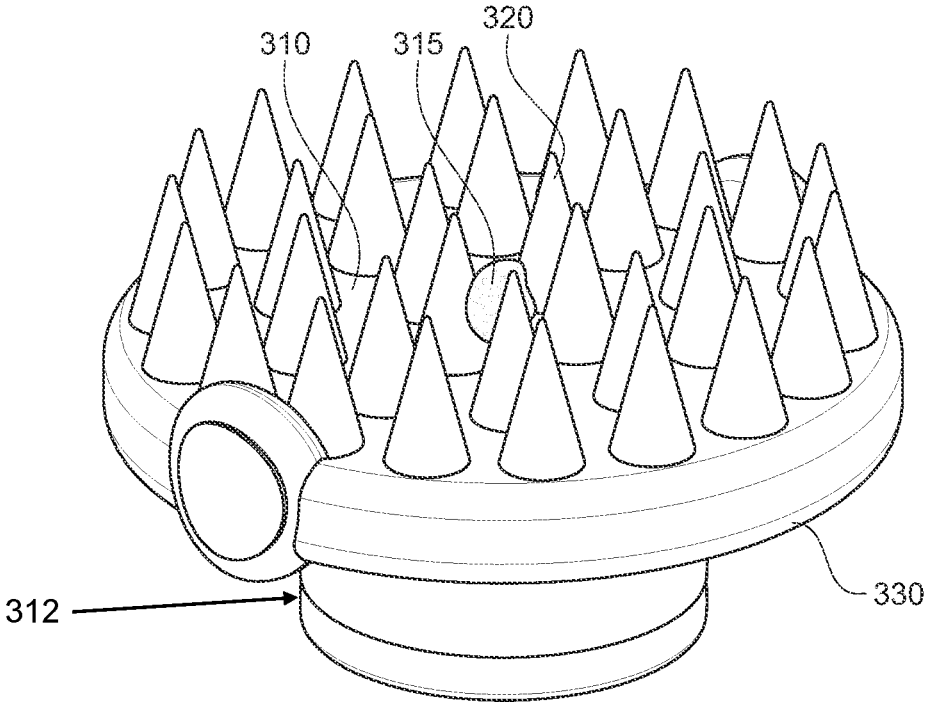
FIG. 3 depicts an illustration showing a perspective view of the exfoliating brush
Figure 4:
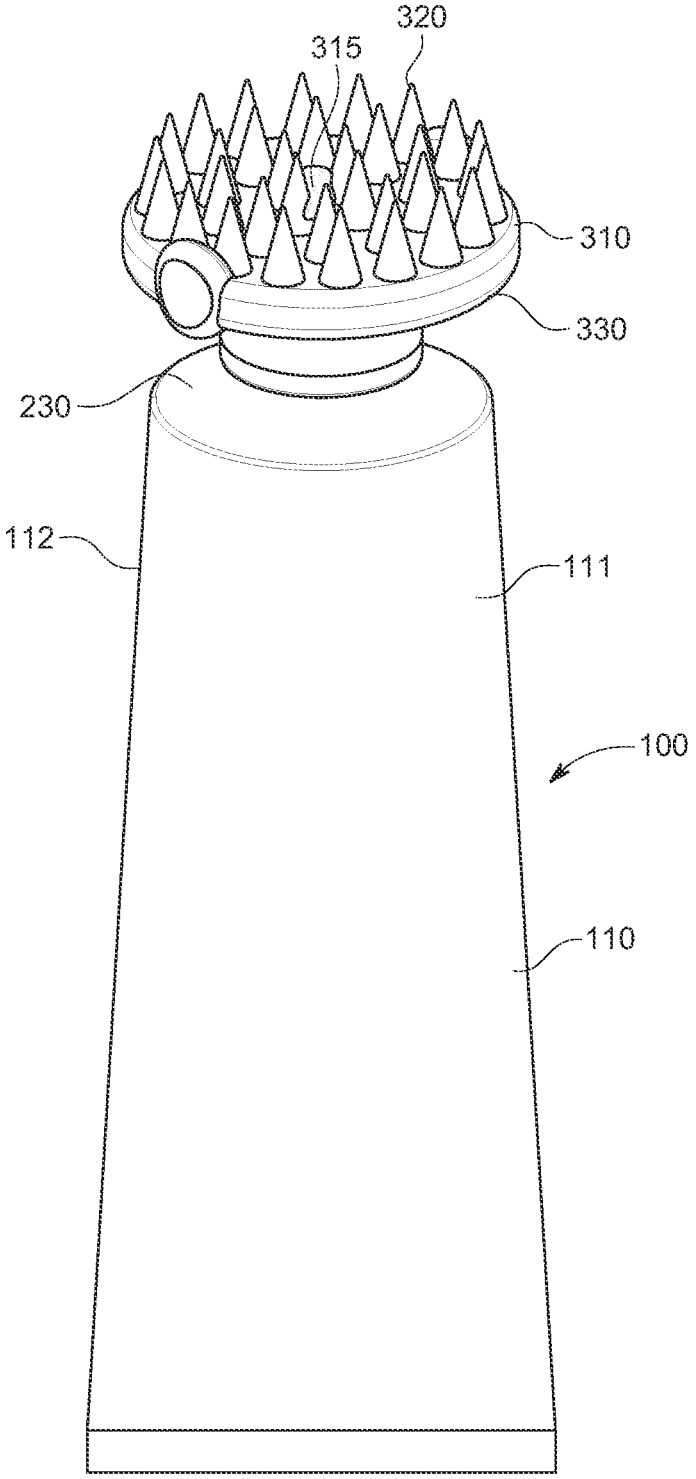
FIG. 4 depicts another illustration showing a perspective view of the exfoliating dispensing system.

In the Summary above and in this Detailed Description, and the claims below, and in the accompanying drawings, reference is made to particular features of the invention. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items" may indicate the presence of only one item or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure recognizes the unsolved need for an improved system and method for a vessel or container with an exfoliating applicator attached to the vessel. One of the many objectives of the present embodiments is to provide a durable, practical, and customizable experience by including an exfoliating brush that screws or attaches to the vessel. Liquid is squeezed or pushed through the main body of the exfoliating brush. During operation, the user holds the exfoliating brush while it is attached to the vessel. The user rubs the produced shaving cream or liquid on their face or head. This spreads the shaving cream or liquid while the bristles/spikes of the exfoliating brush exfoliate skin. As dead skin is brushed, shaving cream is applied to skin at the same time FIG. 1 depicts a non-limiting embodiment of an exemplary exfoliating dispensing apparatus 100. Exfoliating dispensing apparatus 100, in one or more embodiments of the present description, may include, without limitation, components such as a vessel 110 and brush 300.

Vessel 110, in one or more embodiments, has an outer wall and an inner wall. Vessel 110 is configured to serve as a container for a cream or liquid to be placed into (e.g., whereby the cream or liquid either fills wholly within the inner empty space of vessel 110 or partially fills within the inner empty space of vessel 110). Vessel 110 may be made of a front panel 111 and a back panel 112, with front panel 111 and back panels 112 having a top edge portion, a bottom edge portion, a first side edge, and a second side edge. In some non-limiting embodiments, vessel 110 may be cylindrically shaped or any other shape as desired. Vessel 110 may also have a closed bottom surface.

Front panel 111 may be connected to the back panel 112 along first and second continuous side seams to form a generally triangular pouch construction and to collectively define the inter chamber thereof. The bottom edge portion of an embodiment of vessel 110 may include a bottom gusset panel. The gusset panel includes a first side panel (which provides a first gusset portion), which is secured to the front panel 111 along a curved seal region and a second side panel (which provides a second gusset portion) which is secured to the back panel 112 along a similar curved seal region. In some embodiments, the pouch may also have a bottom stabilizing piece at the bottom to provide further stabilization.

When a cream or liquid is placed into vessel 110, the gusset panel is displaced outwardly from the interior chamber of vessel 110 resulting in a displacement distance separating a portion of the front panel 111 away from the back panel 112 by a distance relative to the width of the gusset panel.

Near the top edge portion of vessel 110 may have an attachable or be otherwise fastened to a neck 230 at the top of vessel 110. Vessel 110 may be removably connected to a brush 300. For example, neck 230 may comprise threads and brush 300 may have a twist screw cap that twists onto and seals the neck to prevent leaks and allow access to the cream or liquid inside of vessel 110.

Neck 230 may have any suitable outward shape in accordance with embodiments of the present disclosure. Neck 230 may have a rounded or circular cross-sectional shape (e.g., as viewed from the top). While in other embodiments, neck 230 may have a triangular shape or any other polygonal shape.

Brush 300 may be made of various materials such as rubber, silicon, or other flexible material. Brush 300 may have a receiving component 312 shaped to fit tightly on neck 230 in order for liquid or cream to flow through without spilling Receiving component 312 may have a hollow neck or funnel shape that reduces in diameter from a top to a bottom Brush 300 may have a circular disc surface 310 that extends upward from receiving component 312 with one or more bristles 320 extending away from vessel 110. Circular disc surface 310 may have an aperture at a center that is in fluid communication with vessel 110 whereby cream or liquid may leave vessel 110 and exit out through aperture 315. Bristles 320 may have different shapes for different exfoliation power such as a cone shape or stripe shape and extend outward in a plurality of circular patterns. Brush 300 may have one or more handles 330 attached to a perimeter of circular disc surface 310 for grabbing brush 300 and twisting brush 300 on or off of neck 230 whereby handles 330 have a concave surface facing away from aperture 315 and the center of brush 300 and extending above and below circular disc surface 310, wherein the one or more handles have an upper portion 197 and lower portion 198 that extend out further away from the exfoliating brush than a middle portion 199. Handles 330 may have one or more ridges to facilitate gripping.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. An exfoliating system comprising: an exfoliating brush configured to connect to a vessel holding a fluid, the exfoliating brush having one or more handles at a perimeter extending outward configured for grabbing the exfoliating brush and twisting the exfoliating brush for removal, wherein the exfoliating brush has a circular disc surface, wherein one or more bristles extend upward from the circular disc surface away from the vessel, wherein the one or more bristles have a cone shape, wherein the circular disc surface has an aperture at a center configured to receive the fluid from the vessel, wherein the one or more handles extend upward past the circular disc surface to a length of the one or more bristles.

2. The exfoliating system of claim 1: wherein the exfoliating brush is made of rubber.

3. The exfoliating system of claim 1: wherein the exfoliating brush has a receiving component for receiving a neck of the vessel.

4. An exfoliating system comprising: an exfoliating brush, wherein the exfoliating brush has one or more handles at a perimeter extending outward for grabbing the exfoliating brush and twisting the exfoliating brush for removal, wherein the one or more handles have a curved surface, wherein the one or more handles have an upper portion and lower portion that extend out further away from the exfoliating brush than a middle portion.

5. The exfoliating system of claim 4: wherein the exfoliating brush is made of rubber.

6. The exfoliating system of claim 4: wherein the exfoliating brush has a funnel shaped receiving component for receiving a neck of a vessel.

7. The exfoliating system of claim 6: wherein the exfoliating brush has a circular disc surface that extends upward from the funnel shaped receiving component.

8. The exfoliating system of claim 7: wherein one or more bristles extend upward from the circular disc surface away from the vessel.

9. The exfoliating system of claim 8: wherein the one or more bristles are arranged in a plurality of circular patterns.

10. The exfoliating system of claim 7: wherein the circular disc surface has an aperture at a center configured to receive fluid from the vessel when the vessel is squeezed.

11. An exfoliating system comprising: an exfoliating brush that is flexible and configured to connect to a vessel holding a fluid, wherein the exfoliating brush has a circular disc surface with one or more bristles extending upward away from the vessel and an aperture at a center to receive the fluid from the vessel when the vessel is squeezed, wherein the circular disc surface has handles at a perimeter for grabbing the exfoliating brush and twisting the exfoliating brush for removal, wherein the handles extend above and below the circular disc surface wherein when the exfoliating brush is connected to the vessel, the handles are not directly connected to the vessel.

12. The exfoliating system of claim 11: wherein the handles have a concave surface facing outward from the circular disc surface.

* * * * *